US006142310A

United States Patent [19]

Haase et al.

[11] Patent Number: 6,142,310

[45] Date of Patent: Nov. 7, 2000

[54] MAGNETIC SWEEPER

[76] Inventors: Gerald Allen Haase, 959 Country Club Rd., Lake Oswego, Oreg. 97034; Gerald Andrew Haase, 1959 NE. 160th Pl., Portland, Oreg. 97230

[21] Appl. No.: 09/187,880

[22] Filed: Nov. 6, 1998

Related U.S. Application Data

[60] Provisional application No. 60/065,729, Nov. 14, 1997.

[51] Int. Cl.[7] ..... B03C 1/00; A47L 5/00

[52] U.S. Cl. ..... 209/215; 209/228; 15/339

[58] Field of Search ..... 209/215, 228, 209/229; 294/65.5; 335/303, 285; 15/105, 1.52, 424, 142, 3

[56] References Cited

U.S. PATENT DOCUMENTS

| | | | |
|---|---|---|---|
| 2,426,795 | 9/1947 | Sjostrom | 209/215 |
| 2,654,480 | 10/1953 | Stem | 209/215 |
| 2,693,279 | 11/1954 | Box et al. | 209/215 |
| 2,709,002 | 5/1955 | Hoff | 209/215 |
| 3,014,586 | 12/1961 | Ross | 209/215 |
| 3,343,675 | 9/1967 | Budd | 209/215 |
| 3,646,492 | 2/1972 | Westermann | 335/285 |
| 4,291,430 | 9/1981 | Hightower | 15/142 |
| 4,407,038 | 10/1983 | Haase | 15/105 |
| 4,554,703 | 11/1985 | Matuki | 15/424 |
| 4,904,376 | 2/1990 | Haase | 209/215 |
| 5,285,904 | 2/1994 | Haase | 209/215 |

FOREIGN PATENT DOCUMENTS

| | | | |
|---|---|---|---|
| 499121 | 1/1954 | Canada | 209/215 |
| 2249212 | 5/1975 | France | 209/215 |

*Primary Examiner*—Donald P. Walsh
*Assistant Examiner*—Daniel K Schlak
*Attorney, Agent, or Firm*—Olson and Olson

[57] ABSTRACT

The magnetic sweeper of this invention includes a laterally elongated hollow body of non-magnetic material having an open top and containing a pair of laterally spaced permanent magnets. The elongated side walls of the body have outwardly extending flanges slidably receiving a pair of covers of non-magnetic material for the magnets, and the covers have outer downturned ends facing the closed end walls of the body. An opening in each downturned end removably receives a wheel axle having an enlarged end captured between the body end wall and the adjacent downturned end of the cover, and interengaging detents on the body and each cover secures the cover removably to the body. A wheel is mounted rotatably on each axle and a handle extends from the body member for manipulating the sweeper over a surface to be swept of metallic objects.

6 Claims, 2 Drawing Sheets

MAGNETIC SWEEPER

This application claims the benefit of Provisional application Ser. No. 60/065,729, filed Nov. 14, 1997.

BACKGROUND OF THE INVENTION

This invention relates to magnetic sweepers, and more particularly to an improvement over my earlier magnetic sweeper disclosed in U.S. Pat. No. 5,285,904 which, by this reference, is made a part hereof.

The magnetic sweeper disclosed in my patent aforesaid performs very well, but the structural complication imposes excessive costs of manufacture and assembly.

SUMMARY OF THE INVENTION

The magnetic sweeper of this invention utilizes the same elongated magnet containing body as my earlier patent but provides magnet covers at the ends of the body with offset end portions arranged to extend along the ends of the body to removably capture between them the headed ends of wheel axles. The shaft of each wheel axle extends outward freely through an opening in the associated end portion of the cover, for mounting a wheel.

It is the principal objective of this invention to provide a magnetic sweeper construction that overcomes the aforementioned limitations of my earlier magnetic sweeper.

Another objective of this invention is to provide a magnetic sweeper of the class described which significantly reduces manufacturing cost and the time of assembly of the component parts.

A further objective of this invention is to provide a magnetic sweeper of the class described in which wheel supporting axles are formed as separate components arranged for removable mounting on the magnet housing body.

A still further objective of this invention is to provide a magnetic sweeper of the class described in which wheel supporting axles are supported removably in bearing openings formed in integral, offset end portions of a magnet cover.

The foregoing and other objects and advantages of this invention will appear from the following detailed description, taken in connection with the accompanying drawings of a preferred embodiment.

DESCRIPTION OF THE PREFERRED EMBODIMENT

Figures 1, 2, 3:
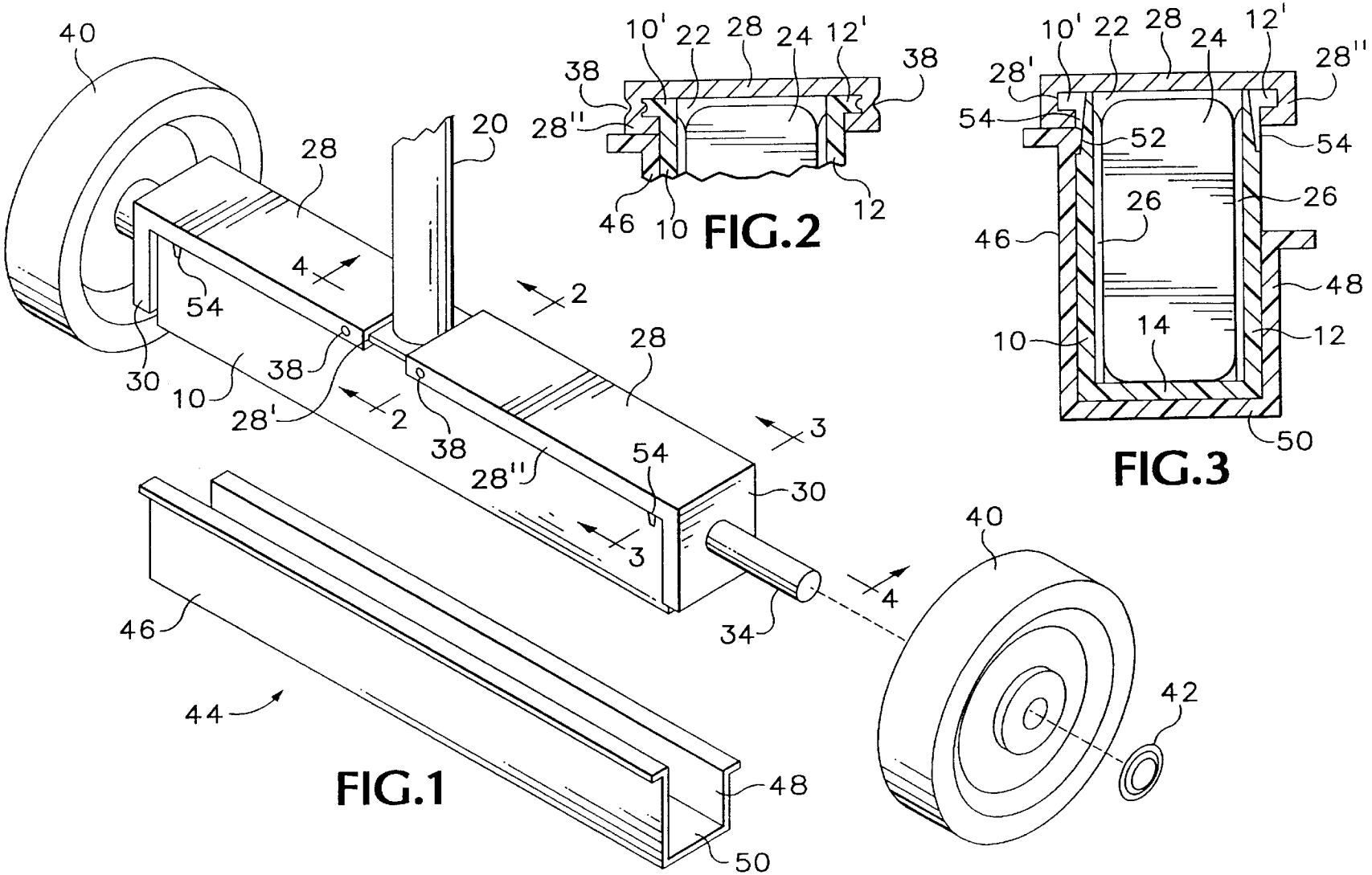
FIG. 1 is a fragmentary exploded perspective view of a basic sweeper construction embodying the features of this invention, the right-hand wheel being separated from the sweeper body to disclose details of internal construction and the removable cleaning catcher being separated from the sweeper body to clearly illustrate its removability.
FIG. 2 is an enlarged fragmentary sectional view taken on the line 2—2 in FIG. 1.
FIG. 3 is an enlarged sectional view taken on the line 3—3 in FIG. 1, with the removable catcher installed.

As illustrated in the drawings, the sweeper comprises an elongated, substantially hollow body member having a front wall 10, a rear wall 12, a bottom wall 14, and opposite end walls 16. The body member is formed of non-magnetic material and preferably is molded of plastic in a one-piece construction to minimize manufacturing costs.

Figure 4:
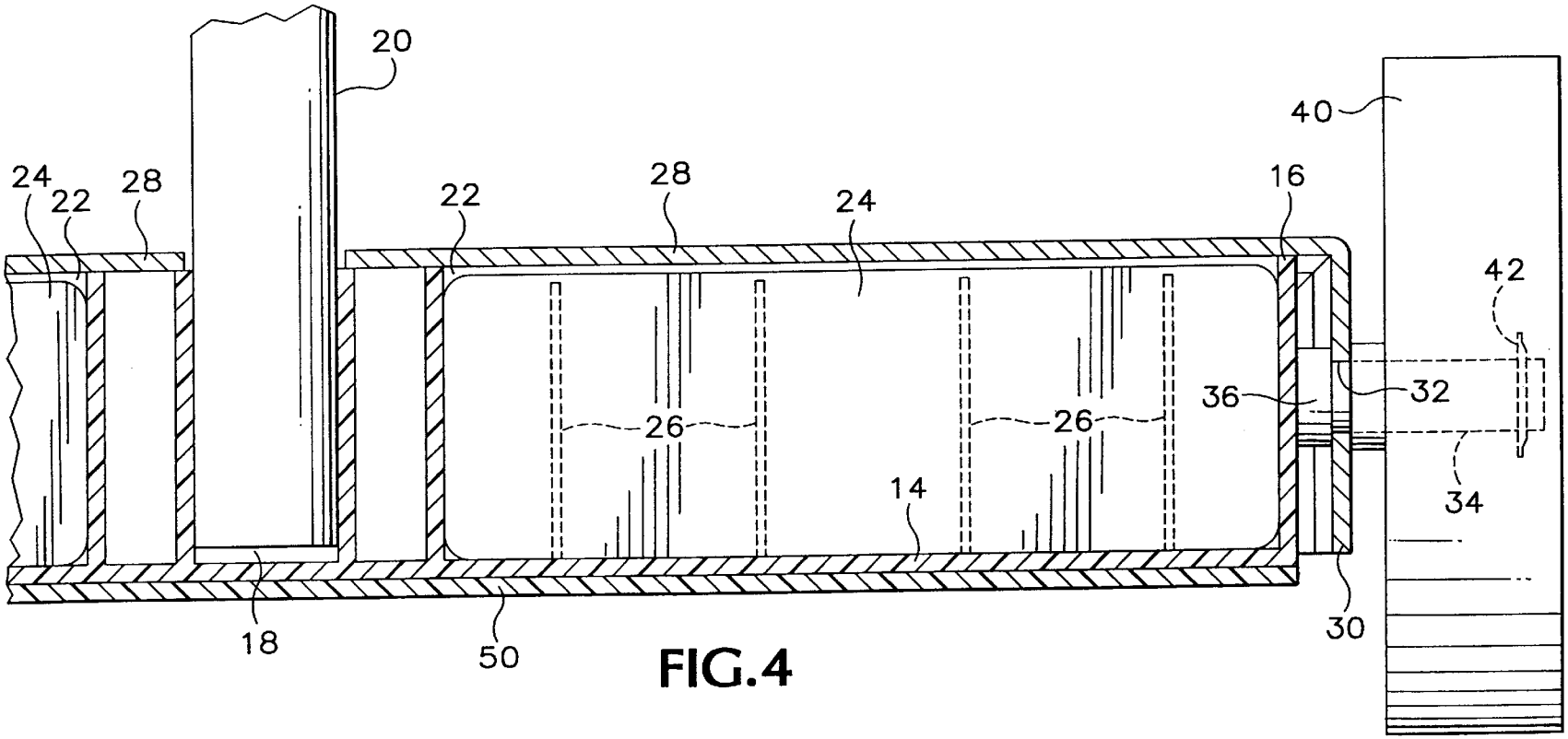
FIG. 4 is an enlarged longitudinal fragmentary sectional view taken on the line 4—4 in FIG. 1, the removable catcher being shown in installed condition.

As illustrated in FIGS. 1 and 4, the body member is configured with a handle socket member 18 disposed preferably central between the ends of the body member. The socket member is configured to receive a handle member 20, as by press fit, for extension therefrom and of sufficient length to be comfortably held by hand while the wheels supporting the body member are disposed in rolling contact with an underlying floor or other surface.

Referring primarily to FIGS. 3 and 4 of the drawings, the body member includes a pair of hollow compartments 22 extending laterally outward from each side of the handle socket member 18 to the end walls 16. Each of these compartments is configured to receive a permanent magnet, preferably a single, elongated magnet 24. These magnets may be retained in their respective compartments against rattling movement, etc., by any suitable, conventional means such as by configuring the compartments to dimensions that frictionally secure the magnets in place, or by adhering the magnets in their respective compartments with adhesive or the like, or by inwardly projecting tabs 26 molded into the side walls 10 and 12 to frictionally grasp the magnets.

Top cover means is provided to be secured to and overlie the top of the body member, to enclose the magnet-containing compartments. In the embodiment illustrated, the upper edges of the front wall 10 and the back wall 12 include outwardly projecting flanges 10', and 12', respectively, that are configured to be received within the corresponding guide slots 28' in the flanges 28" extending downward from the outer lateral sides of the cover plates 28. The cover plates preferably are extruded from non-magnetic material such as synthetic thermoplastic resin or rigid, non-magnetic metal such as aluminum, as is illustrated.

The laterally outer end portions 30 of each cover plate 28 is bent downward 90° from the main portion 28 and is provided with a hole 32 the axis of which extends parallel to the longitudinal axis of the hollow body member. The hole 32 removably receives a stub axle 34 provided at its inner end with an enlarged head 36 arranged to abut the inner side of the end portion 30. The enlarged head also is configured to abut the associated end wall 16 of the main body, when the cover plate is installed on the main body.

Each of the cover plates 28 is installed by engaging the projecting flanges 10', 12' in the corresponding guide slots 28' and sliding the cover plate inwardly from the outer end of the body toward the handle socket member 18. Once installed, the cover plates help to rigidify the body member while also serving to enclose the magnet-containing compartments 22. The cover plates may be secured in their installed condition by any conventional means, such as by bonding or crimping 38 (FIG. 2) to the flanges. Once the cover plates are installed, the axles 34 project substantially rigidly outward from the end portions 30 of the cover plates, with the heads 36 captured between the end walls 16 and end portions 30, whereupon the wheels 40 may be fitted onto the axles and secured by retainer washer 42 or other suitable means.

The magnetic sweeper illustrated in FIG. 1 also includes a removable metallic debris catcher 44 configured for quick and easy installation and removal overlying the front, rear and bottom walls of the body member. In the embodiment illustrated, the catcher comprises a substantially U-shaped member having longitudinal sides 46 and 48 and connecting bottom 50. It preferably is formed by extruding a non-magnetic material such as synthetic thermoplastic resin and then cutting to lengths sufficient to cover the front, rear and bottom walls of the body member between the end walls 16. The catcher further is configured so as to fit snugly onto the body member for a tight but removable frictional fit to prevent inadvertent separation of the catcher except when it is intentionally pulled off by the operator of the sweeper.

To insure against inadvertent separation, the taller side 46 of the catcher is provided at each of the inner, upper corner portions with a projecting detent 52. Cooperating notches 54 are provided on the front and rear walls 10 and 12 of the body member, adjacent their outer ends, for registration with the detents when the catcher is installed on the body. By providing such notches on both front and rear walls, the catcher may be installed reversibly, i.e. with the taller side 44 abutting the front wall 10 or the rear wall 12.

In operation, the magnetic sweeper, with the removable catcher 44 installed thereon, is rolled over a floor surface whereby the magnetic attraction of the magnets 24 contained within the body compartments 22 causes loose metallic objects and debris on the floor surface to be picked up and held against the surface area of the catcher. When the floor sweeping operation is completed, the sweeper may be held over a garbage receptacle or the like and the catcher grasped at one of its ends and pulled downwardly to separate it from the body member and the magnetic attraction provided by the magnets. The metallic objects previously held against the catcher now simply fall away and are collected in the receptacle for discard. The catcher then is reinstalled on the body member and the magnetic sweeper is once again ready for use.

The provision of the bent end portions 30 of the cover plates 28 with openings 32 for headed axles 34, and the provision of the detents 52 and cooperating notches 54, represent the novel features of construction which differ from the structural arrangement disclosed in my earlier patent aforesaid. These novel features may be incorporated in the multiple body embodiments shown in FIGS. 4 and 5 of my earlier patent.

It will be apparent to those skilled in the art that various changes may be made in the size, shape, number, type and arrangement of parts described hereinbefore without departing from the spirit of this invention and the scope of the appended claims.

What is claimed is:

1. A magnetic sweeper comprising:

a) a laterally elongated body member of non-magnetic material having front, rear, bottom and end walls defining a compartment open at the top thereof, b) permanent magnet means in the compartment adjacent each of the opposite ends thereof for attracting magnetically susceptible objects to be swept from a surface, c) cover means of non-magnetic material releasably secured to the body member for covering the permanent magnet means, d) the cover means having downwardly extending end sections confronting the associated end walls of the body member, each end section having an opening therethrough for reception of an axle member, e) an axle member extending removably through each opening in said end sections and having an enlarged end confined between the body member end wall and confronting associated end section of the cover means, f) a wheel mounted on each axle member for moving the sweeper over a surface to be swept of metallic objects, g) a catcher member of non-magnetic material having front, rear and bottom sides, the front and rear sides being configured to engage the front and rear outer sides of the body member with the bottom side of the catcher member overlying the bottom side of the body member, and h) handle means operatively engaging the body member for manipulating the sweeper over a surface to be swept of metallic objects.

2. The magnetic sweeper of claim 1 wherein the permanent magnet means comprises a plurality of permanent magnets one adjacent each end of the compartment, and the cover means comprises a plurality of cover members secured releasably to the body member for covering said permanent magnets, each cover member having a downwardly extending end section with an opening therethrough for receiving an axle member.

3. The magnet sweeper of claim 1 including means interengaging the body member and cover means for securing the cover means releasably to the body member.

4. The magnet sweeper of claim 1 including outwardly extending flanges on the upper ends of the front and rear walls of the body member, downwardly extending flanges on the outer lateral sides of the cover means having longitudinally extending guide slots for slidably receiving the flanges on the front and rear walls of the body member for mounting the cover means on the body member, and means interengaging the cover means and body member for securing the cover means releasably to the body member.

5. The magnet sweeper of claim 1 wherein the front and rear walls of the catcher member are of different heights, detent means are formed on upper portions of the inner side of the taller wall, and notch means are formed on the outer sides of the front and rear walls of the body member in positions to register with the detent means on the taller wall to secure the catch member releasably and reversibly to the body member.

6. A magnetic sweeper comprising:

a) a laterally elongated body member of non-magnetic material having front, rear, bottom and end walls defining a compartment open at the top thereof, b) a plurality of permanent magnets one adjacent each end of the compartment, c) a plurality of cover members of non-magnetic material secured releasably to the body member for covering said permanent magnets, each cover member having a downwardly extending end section with an opening therethrough for receiving an axle member, d) outwardly extending flanges on the upper ends of the front and rear walls of the body member, downwardly extending flanges on the outer lateral sides of the cover members having longitudinally extending guide slots for slidably receiving the flanges on the front and rear walls of the body member for mounting the cover members on the body member, and means interengaging the cover members and body member for securing the cover members releasably to the body member, e) an axle member extending removably through each opening in said end sections and having an enlarged end confined between the body member end wall and confronting associated end section of the cover members, f) a wheel mounted on each axle member for moving the sweeper over a surface to be swept of metallic objects, g) a catcher member of non-magnetic material having front, rear and bottom sides, the front and rear sides being configured to engage the front and rear outer sides of the body member with the bottom side of the catcher member overlying the bottom side of the body member, h) the front and rear walls of the catcher member being of different heights, i) detent means on upper portions of the inner side of the taller wall, j) notch means on the outer sides of the front and rear walls of the body member in positions to register with the detent means on the taller wall to secure the catch member releasably and reversibly to the body member, and k) handle means operatively engaging the body member for manipulating the sweeper over a surface to be swept of metallic objects.

* * * * *